US006161945A

United States Patent [19]

Baiardi

[11] Patent Number: 6,161,945

[45] Date of Patent: Dec. 19, 2000

[54] PROJECTOR DEVICE FOR A MULTI-COLOR LIGHT BEAM

[75] Inventor: Bruno Baiardi, Felizzano, Italy

[73] Assignee: Space Cannon VH S.R.L., Fubine, Italy

[21] Appl. No.: 09/269,274

[22] PCT Filed: Sep. 10, 1997

[86] PCT No.: PCT/EP97/04974

§ 371 Date: Mar. 25, 1999

§ 102(e) Date: Mar. 25, 1999

[87] PCT Pub. No.: WO98/14732

PCT Pub. Date: Apr. 9, 1998

[30] Foreign Application Priority Data

Oct. 2, 1996 [IT] Italy ..... RE96A0078

[51] Int. Cl.[7] ..... F21L 7/00

[52] U.S. Cl. ..... 362/277; 362/186; 362/280; 362/281; 362/293; 362/284; 362/324

[58] Field of Search ..... 362/277, 280, 362/281, 293, 319, 324, 284, 186

[56] References Cited

U.S. PATENT DOCUMENTS

| | | | |
|---|---|---|---|
| 437,178 | 2/1890 | Gulliksen . | |
| 3,703,635 | 11/1972 | Burkarth . | |
| 5,165,781 | 11/1992 | Orak | 362/186 |
| 5,353,211 | 10/1994 | Merko . | |
| 5,642,931 | 7/1997 | Gappelberg | 362/186 |

FOREIGN PATENT DOCUMENTS 3908148 9/1990 Germany .

*Primary Examiner*—Thomas M. Sember
*Attorney, Agent, or Firm*—Birch, Stewart, Kolasch & Birch, LLP

[57] ABSTRACT

A light beam projector device having a light source and a reflector arranged to direct the light originating from the light source in such a manner as to form a light beam, said reflector having a curved concave reflecting surface with a geometrical focus where the light source is positioned, at least a first tubular wall made of a material able to filter color from the light and arranged when set in an active position to laterally embrace the light source so as to be traversed by the light before it reaches the reflector, the tubular wall being arranged with its axis substantially coinciding with the axis of the reflector, actuator means for axially moving the tubular wall into an active position or to an inactive position below the reflector where it does not interfere with the radiation emitted by the light source and directed towards the reflector, and to intermediate positions in which only a part of the tubular wall is traversed by the light, and a second tubular wall or tubular wall segment positioned coaxially with the first tubular wall and arranged, when in its active position, to laterally embrace the light source so as to intercept the radiation emitted by the light source, the second tubular wall or wall segment being made of a transparent material with its surface suitably treated physically to diffuse the radiation before it reaches the reflecting surface.

10 Claims, 4 Drawing Sheets

PROJECTOR DEVICE FOR A MULTI-COLOR LIGHT BEAM

This application is the national phase under 35 U.S.C. §371 of PCT International Application No. PCT/EP97/04974 which has an International filing date of Sep. 10, 1997, which designated the United States of America.

TECHNICAL FIELD

This invention relates to a variable-colour light beam projector of medium or high power (up to 50,000 watt and beyond), having a light source and reflector means arranged to direct the light from the light source in such a manner as to form a light beam.

In U.S. Pat. No. 3,703,635 a light beam projector device is disclosed having a light source and reflector means arranged to direct light from the source in a beam; a wavelength filter in the form of a tubular wall is provided arranged to surround the light source so as to be traversed by the light before this reach the reflector; this tubular wall is movable to an inactive position in which it does not interfere with the light radiation to the reflector.

In DE-A-39 08 148 a light beam projector device is disclosed having a plurality tubular colour filter walls positioned coaxially one within another and close together, each being dedicated to supply a different colour to the light which passes through it; these tubular walls are arranged to be moved independently of each other, and to create in mutual combination a plurality of different colours.

An object of the present invention is to provide a system able to vary the light beam colour which is effective, long-lasting and of relatively simple and lightweight construction.

DISCLOSURE OF THE INVENTION

This and further objects are attained by the invention as characterised in the claims.

The invention concerned is based on the fact that it comprises at least one tubular wall of a material able to filter colour from the light, and arranged, when set in its active position, to laterally embrace the projector light source so as to be traversed by the light before this reaches the reflecting surface, said tubular wall being arranged with its axis substantially coinciding with the axis of the reflecting surface. With the tubular wall there are associate actuator means able to axially move said tubular wall into said active position or to an inactive position, below the reflecting surface, in which it does not interfere with the radiation emitted by the source and directed towards the reflecting surface, and to intermediate positions in which only a part of the tubular wall is traversed by the light.

Furthermore, a second tubular wall, or at least a tubular wall segment, is provided which is positioned coaxially with the first tubular wall and is arranged when in its active position to laterally embrace the light source so as to intercept the radiation emitted by the light source, the second tubular wall or wall segment being of transparent material with its surface suitably treated physically to achieve a frosted light effect which randomly deviates the radiation before it reaches the reflecting surface.

According to another embodiment, the device comprises a light source and reflector means arranged to direct the light originating from the source in such a manner as to form a light beam, wherein said reflector means comprise a curved concave reflecting surface at the geometrical focus of which there is positioned the light source; furthermore it comprises a plurality of tubular walls of a material able to filter colour from the light, each being dedicated to supplying a different colour to the light which passes through it, positioned coaxially one within another and close together, arranged with their axis substantially coinciding with the axis of the reflecting surface; said tubular walls are arranged, when set in their active position, to laterally embrace the projector light source so as to be traversed by the light before this reaches the reflecting surface, and are arranged to be moved independently of each other, and to create in mutual combination a plurality of different colours.

The invention is described in detail hereinafter with the aid of the accompanying figures, which illustrate a non-exclusive embodiment thereof.

The projector of the invention, indicated overall by 1 in the figures, comprises in the usual manner a light source 10, consisting in particular of an arc lamp the electrodes 11 and 12 of which are arranged substantially on the same axis.

The light produced by the lamp 10 is reflected by suitable reflector means 20 which create a light beam, which can be of constant section or be diverging.

Figure 1:
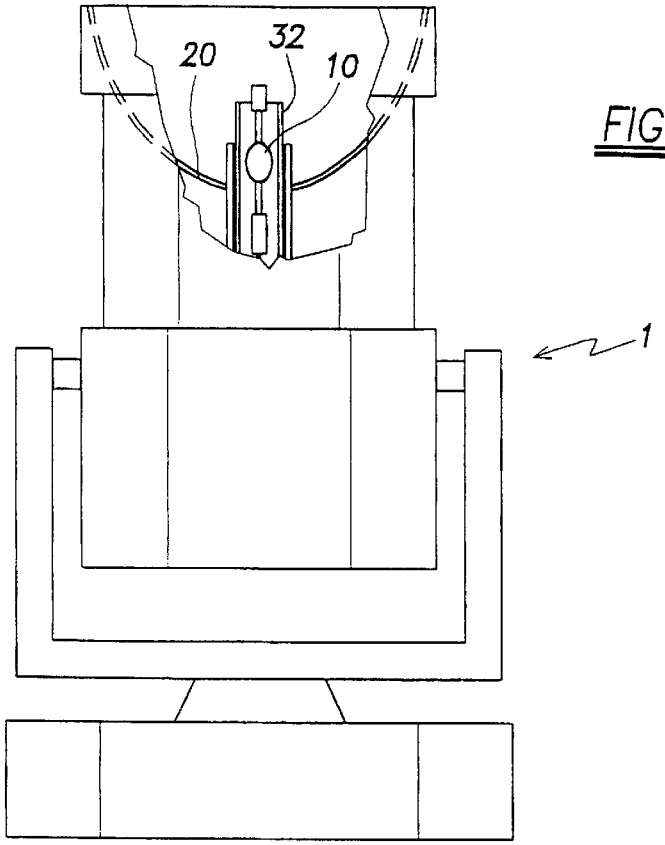
FIG. 1 is a schematic view of a light beam projector incorporating the characteristics of the present invention.
Figure 4:
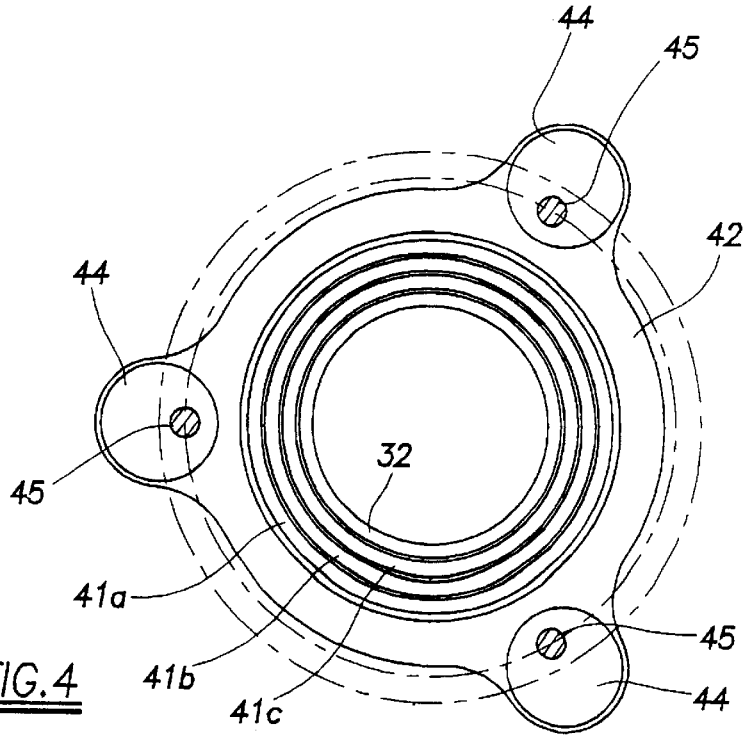
FIG. 4 is a section on the plane IV—IV of FIG. 3.
Figure 2:
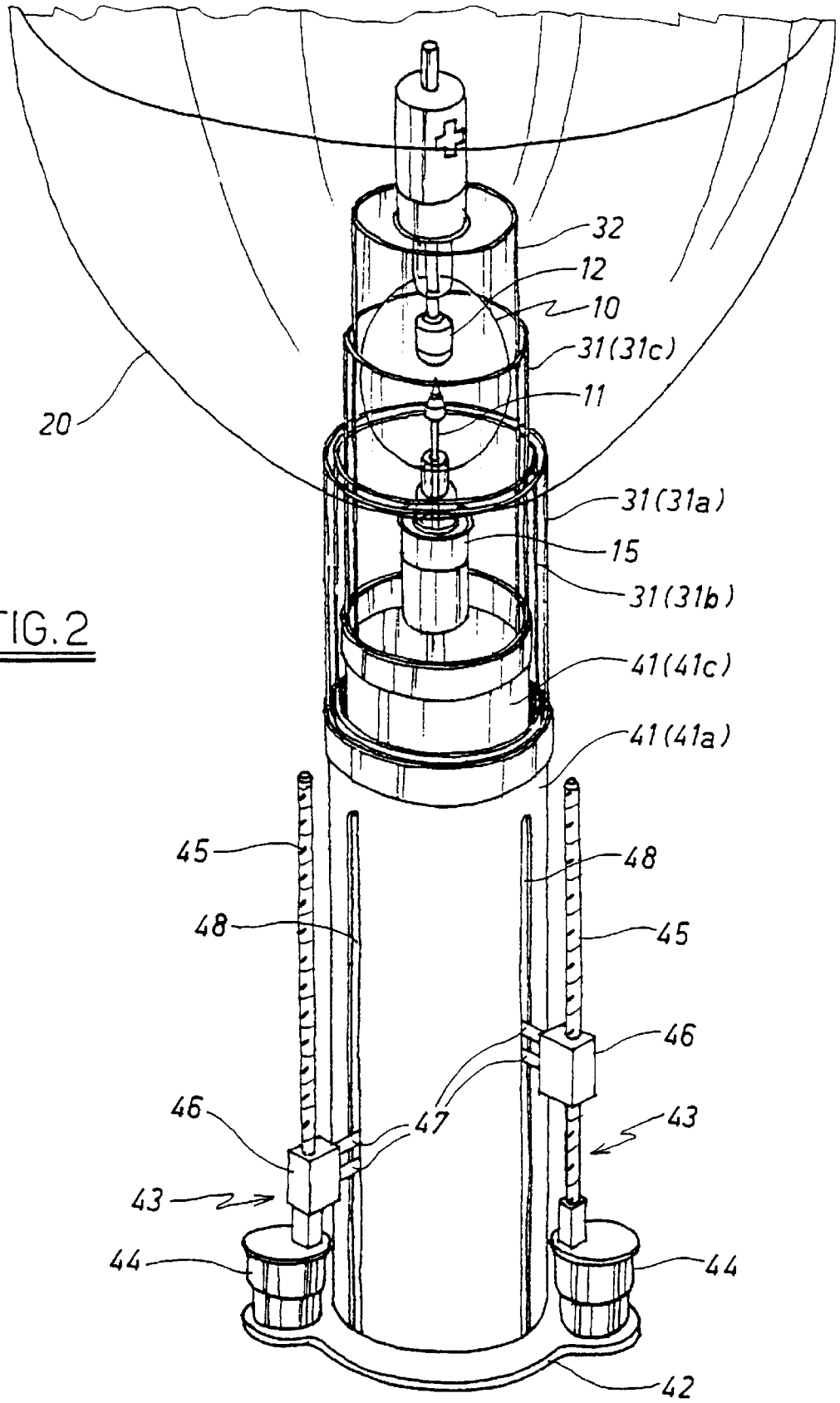
FIG. 2 is a perspective view of that part of the projector in which the means according to the invention are positioned.
Figure 3:
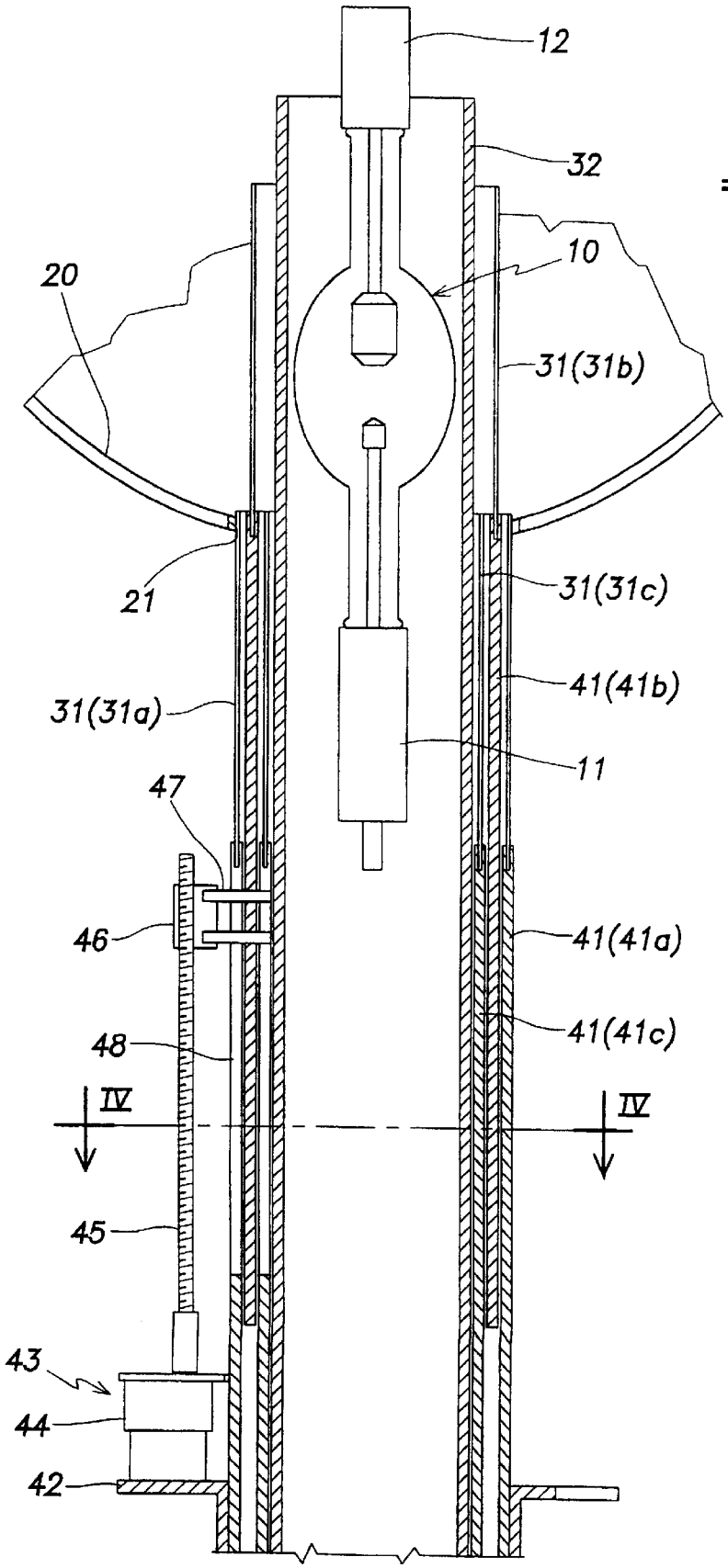
FIG. 3 is a section on an axial plane through FIG. 2.

Specifically, said means 20 consist of a concave curved reflecting surface, at the geometrical focus of which there is positioned the light source 10. The electrodes 11 and 12 thereof are positioned substantially on the axis of the reflecting surface 20, one of them, namely the electrode 11, being positioned through an aperture 21 provided in the reflecting surface 20 and centered on the vertex of this latter. The free end of the electrode 11 is connected to a suitable lamp holder 15 (not shown in FIG. 3) positioned externally to the reflecting surface 20.

According to the invention the projector comprises at least one tubular wall 31 of a material able to filter colour from the light (for example a coloured quartz), ie such as to provide a certain colour to the light passing through it. When in its active position the tubular wall 31 laterally surrounds and embraces the lamp 10, so that the radiation emitted by it passes through the tubular wall 31 before reaching the reflecting surface 20.

Preferably a plurality of said tubular walls 31 are provided, positioned coaxially one within another and relatively close together (they can in fact be in mutual sliding contact), each dedicated to providing a different colour to the light which passes through them. In particular, said walls 31 have a constant cross-section in the form of a circular ring of relatively small thickness.

All the walls 31 are arranged with their axis substantially coinciding with the axis of the reflecting surface 20 and are moved from their active position to an inactive position, below the reflecting surface 20, by being shifted in the direction of its axis, through the aperture 21.

In addition to the filtering walls 31 there is provided a fixed tubular transparent-material wall 32 coaxial with the others, which embraces the lamp 10 and forms a passage corridor for the cooling air which grazes the lamp.

By suitable means, described below, the tubular walls 31 are moved from their active position to their inactive position, external to the reflecting surface 20, in which they do not interfere with the radiation emitted by the source and directed towards the reflector means and vice versa.

In the embodiment shown in FIGS. 1–4, the fixed wall 32 is prolonged downwards to the outside of the reflecting surface 20, where it is supported rigid with said surface 20.

About the lower part of the wall 31 there are positioned a number of tubular metal supports 41 in the form of a relatively thin tube, positioned one inside another in mutual contact. Each support 41 carries a respective tubular wall 31, fixed to its upper edge.

In the illustrated example there are provided three tubular walls (indicated by 31*a,* 31*b* and 31*c*) and hence three supports 41 (indicated by 41*a,* 41*b* and 41*c*).

External to the most outer support 41 there is provided a ring 42 which embraces the group of supports 41. The ring 42 is spaced from the reflecting surface 20 and supports three linear actuators 43, each provided with a motor 44 which rotates a vertical lead-screw 45 along which a lead-nut 46 moves.

To each lead-nut 46 there is connected a respective tubular support 41 by means of a pair of radial pins 47. Where the pins 47 involve a support positioned within other supports, in these latter there is provided a vertical slot 48 for passage of the pins 47.

Hence on operating the motors 44, the lead-nuts 46 move vertically to shift the tubular walls 31, so that these can be selectively and independently moved into an active position about the lamp 10, or be lowered below the reflecting surface 20 into an inactive position, in which they do not interfere with the radiation emitted by the lamp 10.

Figure 5:
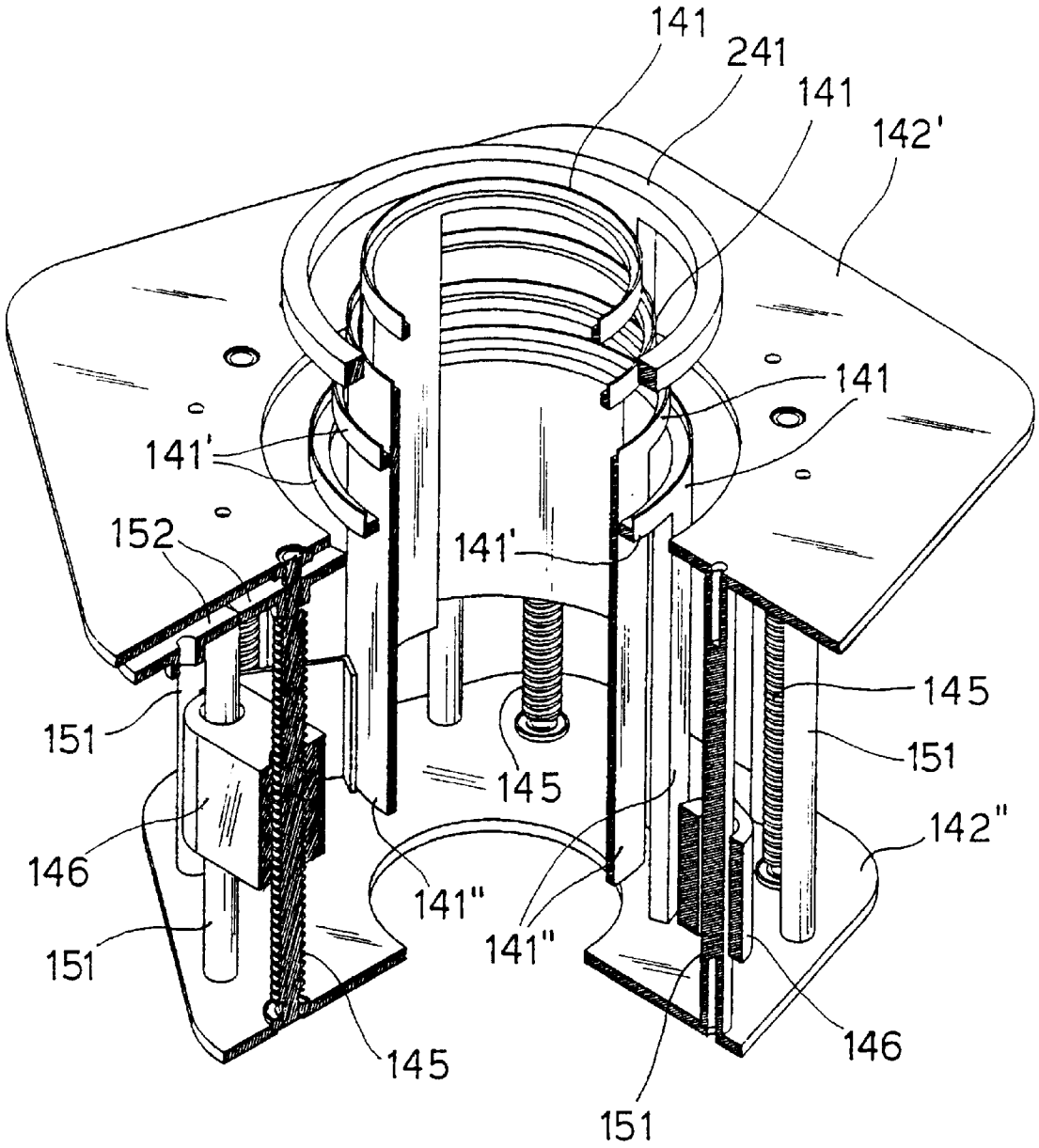
FIG. 5 is a perspective view, with parts shown in section, of a second embodiment of the means for moving the tubular walls 31 arranged to embrace the lamp 10.

FIG. 5 shows a second embodiment of the means for moving the tubular walls 31, these latter being substantially the same as those shown in the preceding figures and not being illustrated in order to better display the other parts. The tubular walls 31 are fixed by their lower edge to the upper edge of the respective supports 141, each consisting of an upper ring 141', on which there is fixed the respective wall 31, from which there downwardly extends in a vertical direction an angular cylindrical wall portion 141". Said supports 141 are of mutually different diameters so as to be able to mutually slide one within another, and are coaxial with each other and with the reflecting surface 20. FIG. 5 shows four supports 141 for four tubular walls 31.

There is also provided a further support 241, similar to and coaxial with the supports 141, which serves to move the reflecting surface 20 through a few millimeters while the lamp 10 remains at rest, in order to vary, within a range of action of a few degrees, the collimation angle of the beam of rays reflected by the surface 20.

About the supports 141 there are positioned, rigid with the projector structure, fixed horizontal plates 142' and 142" superposed one on but spaced from the other and each having a hole for the passage of the supports 141 and 241. Between the two plates 142' and 142" there are provided a plurality of pairs of vertical columns 151 (in a number equal to the number of supports 141 and 241) angularly distributed about the supports 141 and having their upper and lower ends fixed to the plates 142' and 142". Along each pair of columns there engages a respective slider 146 provided with vertical holes by which it engages the columns 151 in a vertically slidable manner. Each slider 146 also engages, via a threaded hole, a respective vertical lead-screw 145 freely rotatable about its axis and positioned between two columns to rotatably engage the plates 142' and 142". To each slider 146 there is fixed a bracket 147 fixed to the wall portion 141" of a respective support 141, 241. The wall portions 141" are angularly distributed such as to leave a passage free for the brackets 147 relative to the other portions 141". The lead-screws 145 are rotated by small electric motors (not shown in the figures) via pairs of gears 152.

On operating the motors the lead-screws 145 rotate to vertically move the sliders 146 and with them the tubular walls 31, so that these can be brought mutually independently into an active position about the lamp 10, or be lowered below the reflecting surface 20, into an inactive position in which they do not interfere with the radiation emitted by the lamp 10.

By moving one or more walls 31 into the active position by means of the respective motors/lead-screw/lead-nut 44, 45, 46, 145, 146, the light emitted by the lamp 10 passes through these walls and is hence filtered by them (to thus assume a determined colour), after which it is projected as a light beam by the reflecting surface 20. The projector 1 hence emits a coloured light beam 2.

The walls 31 define light filters, the combination of which (either by subtraction or by addition) enables a large number of different light colours to be obtained. As the walls can be positioned in an active or inactive position independently of each other, a large number of different colours can be obtained by their different combinations.

Furthermore the walls 31 can be arranged in an intermediate position, ie a position in which only a part of them is traversed by the light, their other part being positioned below the reflecting surface 20. In this manner only a part of the radiation emitted by the lamp 10 is filtered, so increasing the number of possible different colours.

The material of which the tubular walls is composed can vary. For example, it can be a quartz glass coloured at source by special paints or coloured by dichroic colouring.

In addition, the colour tone can vary on one and the same wall 31 in passing from one end of the tube to the other. This enables the colour tone of the light emitted by the projector to vary as the axial position of the wall 31 relative to the lamp 10 varies, to hence increase the range of possible colours.

In addition, one of the tubular walls 31 can be of opaque material, ie which does not allow light to pass. Consequently when such a wall is located in its active position, it embraces the light source 10 so as to intercept the radiation emitted by the source 10 and prevent it from reaching the reflecting surface 20. In this manner the projector light is completely obscured. Said tubular wall can be moved from said active position to an inactive position in which it does not interfere with the radiation emitted by the source 10 and directed towards the reflector means 20 and vice versa. Said opaque tubular wall serves as a light dimmer device.

In addition, to achieve a diffused light effect (which in technical jargon is known as frosted), one of the tubular walls 31 can be of transparent material with its surface suitably treated physically to achieve this effect. In practice, to create said light effect it is known to treat the (borosilicate) glass surfaces by sand-blasting, to create on the treated surface a multiplicity of very small concavities.

When set in its active position, this tubular wall embraces the light source 10 to intercept the radiation emitted by the source. Hence as the radiation passes through the sand-blasted wall it becomes randomly deviated by the small concavities in the wall before reaching the parabolic reflecting surface 20, hence creating a diffused frosted light effect.

As in the case of the other tubular walls, this tubular wall can also be moved from said active position to a lower inactive position in which it does not interfere with the radiation emitted by the source 10 and directed towards the reflector means 20, and vice versa.

This frosted light wall 31 in combination with at least one coloured wall 31, this latter being placed in any intermediate position, randomly deviates the coloured and white radiation before they reach the reflecting surface, so producing an uniformly coloured beam, whose colour is the combination of a pure coloured light with a pure white light, so making the projector device able to emit a light beam which can vary within a continuous range of different colour shadings or different colour degrees.

Instead of a whole tubular wall 21, only a portion thereof could be used, in particular the upper portion of the tubular wall serving to obscure the light, and treated (sand-blasted) to obtain said diffused light.

Numerous modifications of a practical and applicational nature can be applied to the present invention, but without leaving the scope of the inventive idea as claimed hereinafter.

The present invention improves the quality of the light emitted by the projector because that material considered most suitable for the optical filter can be used whatever its type, and because the light is filtered before being reflected by the reflecting surface.

Again, with the present invention the colours can be very rapidly varied.

Moreover the means by which the light is varied according to the invention are neither heavy nor bulky.

I claim:

1. A light beam projector device, comprising a light source and reflector means arranged to direct the light originating from the light source in such a manner as to form a light beam, said reflector means comprising a curved concave reflecting surface having a geometrical focus where the light source is positioned, at least a first tubular wall made of a material able to filter color from the light, and arranged when set in an active position, to laterally embrace the light source so as to be traversed by the light before it reaches the reflecting means, said tubular wall being arranged with its axis substantially coinciding with the axis of the reflecting means, actuator means for axially moving said tubular wall into said active position or to an inactive position below the reflecting means where it does not interfere with the radiation emitted by the light source and directed towards the reflecting means and to intermediate positions in which only a part of the tubular wall is traversed by the light, and a second tubular wall or tubular wall segment positioned coaxially with the first tubular wall and arranged, when in its active position, to laterally embrace the light source so as to intercept the radiation emitted by the light source, the second tubular wall or wall segment being made of a transparent material with its surface suitably treated physically to diffuse the radiation before it reaches the reflecting surface.

2. The device as claimed in claim 1, comprising a plurality of said tubular walls which are positioned coaxially one within the other and close together, each being dedicated to supplying a different color to the light which passes therethrough, the tubular walls being arranged to be moved independently of each other, and to create, in mutual combination, a plurality of different colors.

3. The device as claimed in claim 2, wherein the actuator means is arranged to vertically move tubular supports which carry respective tubular walls.

4. The device as claimed in claim 1, further comprising a fixed, tubular transparent-material wall coaxially disposed with respect to the other tubular walls, said fixed tubular wall embracing the light source and forming a passage corridor for a cooling air which grazes the light source.

5. The device as claimed in claim 4, wherein the movable tubular walls are in substantial mutual contact on said fixed tubular wall.

6. The device as claimed in claim 1, wherein said tubular wall is made of an opaque material which is arranged, when in its active position, to embrace the light source so as to intercept the radiation emitted by the light source and prevent it from reaching the reflecting means, said tubular wall being able to be moved from said active position to a lower inactive position in which it does not interfere with the radiation emitted by the light source and directed towards the reflector means and vice versa.

7. The device as claimed in claim 1, wherein said tubular wall or wall segment which has its surface treated to diffuse the radiation is able to be moved from said active position to a lower inactive position in which it does not interfere with the radiation emitted by the light source and directed towards the reflecting surface and vice versa.

8. A light beam projector device, comprising a light source and reflector means arranged to direct the light originating from the light source in such a manner as to form a light beam, said reflector means comprising a curved concave reflecting surface having a geometrical focus where the light source is positioned, a plurality of tubular walls made of a material able to filter color from the light, each being dedicated to supplying a different color to the light which passes therethrough, said tubular walls positioned coaxially, one within the other and close together and arranged with their axis substantially coinciding with an axis of the reflecting means, said tubular walls being arranged, when set in their active position, to laterally embrace the projector light source so as to be traversed by the light before it reaches the reflecting means, and arranged to be moved independently of each other and to create, in mutual combination, a plurality of different colors, actuator means for axially moving said tubular walls into said active position or to an inactive position below the reflecting means where it does not interfere with the radiation emitted by the light source and directed towards the reflecting means and in intermediate positions in which only a part of the tubular wall is traversed by the light, the other part being positioned below the reflecting surface.

9. The device as claimed in claim 8, wherein in order to obtain a diffused frosted light effect, said tubular wall or tubular wall segment of transparent material is physically arranged, when in its active position, to embrace the light source so as to intercept the radiation emitted by the light source and before it reaches the reflecting surface, said tubular wall or segment thereof having its surface treated to diffuse the radiation and being able to be moved from said active position to a lower inactive position in which it does not interfere with the radiation emitted by the light source and directed towards the reflecting surface and vice versa.

10. The device as claimed in claim 8, wherein a tubular wall of opaque material is arranged as a dimmer device when in its active position to embrace the light source so as to intercept the radiation emitted by the light source and prevent it from reaching the reflecting means, said tubular wall being able to be moved from said active position to a lower inactive position where it does not interfere with the radiation emitted by the light source and directed towards the reflecting surface and vice versa.

* * * * *